US007669281B2

(12) United States Patent
Fukuda et al.

(10) Patent No.: US 7,669,281 B2
(45) Date of Patent: Mar. 2, 2010

(54) PORTABLE ELECTRIC VACUUM CLEANER

(75) Inventors: Tatsunori Fukuda, Kasai (JP); Yunosuke Mizushima, Kasai (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 995 days.

(21) Appl. No.: 11/188,847

(22) Filed: Jul. 26, 2005

(65) Prior Publication Data

US 2006/0021180 A1 Feb. 2, 2006

(30) Foreign Application Priority Data

Jul. 28, 2004 (JP) ..... 2004-220670

(51) Int. Cl.
*A47L 5/24* (2006.01)

(52) U.S. Cl. ..... 15/344; 15/350; 15/351

(58) Field of Classification Search ..... 15/327.5, 15/344, 350, 351; *A47L 5/14, 9/08*
See application file for complete search history.

(56) References Cited

U.S. PATENT DOCUMENTS

| | | | | |
|---|---|---|---|---|
| 4,928,346 | A * | 5/1990 | Elson et al. | 15/338 |
| 6,839,934 | B2 * | 1/2005 | Houghton et al. | 15/329 |

FOREIGN PATENT DOCUMENTS

| | | | |
|---|---|---|---|
| JP | 58-40050 | | 3/1983 |
| JP | 59-98852 | | 7/1984 |
| JP | 63-5719 | A | 1/1988 |
| JP | 01-230330 | A | 9/1989 |
| JP | 05-76467 | A | 3/1993 |
| JP | 05-228073 | A | 9/1993 |
| JP | 7-57214 | | 6/1995 |
| JP | 10-276942 | | 10/1998 |
| JP | 11-047045 | A | 2/1999 |
| JP | 11-346972 | | 12/1999 |
| JP | 2003-235773 | A | 8/2003 |

OTHER PUBLICATIONS

Office Action dated Aug. 21, 2008 issued in corresponding Japanese Application No. 2004-220670.
Japanese Office Action dated Nov. 13, 2008, issued in corresponding Japanese Application No. 2004-220670.

* cited by examiner

*Primary Examiner*—David A Redding
(74) *Attorney, Agent, or Firm*—Westerman, Hattori, Daniels & Adrian, LLP

(57) ABSTRACT

A portable electric vacuum cleaner according to the present invention includes a body (23), and a suction nozzle (27) provided unitarily with the body (23) at a front lower portion of the body (23) and projecting forward from the body (23) as having a predetermined length. The suction nozzle (27) is, for example, a tubular member of a fixed shape composed of a resin and tapered toward a distal end thereof. The suction nozzle (27) has a nozzle suction port (271) provided at the distal end thereof. The portable electric vacuum cleaner is generally used with a floor brush (3) attached to the suction nozzle (27). When the floor brush (3) is detached from the body (2), the suction nozzle (27) appears. Thus, the portable electric vacuum cleaner is conveniently used. Further, the suction nozzle (27) is hardly missing.

11 Claims, 10 Drawing Sheets

PORTABLE ELECTRIC VACUUM CLEANER

BACKGROUND OF THE INVENTION

1. Field of the Invention

The present invention relates to a portable electric vacuum cleaner.

2. Description of Related Art

Electric vacuum cleaners conventionally used include portable electric vacuum cleaners. Such a portable electric vacuum cleaner is generally called "handy cleaner", which is used for performing a cleaning operation while manually lifting and carrying a body of the cleaner. With the use of the portable vacuum cleaner, a user can easily clean the upper surfaces of a desk and a shelf, the inside of a car and other places which are difficult to clean by using an ordinary vacuum cleaner. Exemplary portable electric vacuum cleaners of this type are disclosed in Japanese Unexamined Patent Publication No. 11-346972 (1999), Japanese Examined Patent Publication No. 7-57214 (1995) and Japanese Unexamined Patent Publication No. 10-276942 (1998).

The portable electric vacuum cleaner disclosed in Japanese Unexamined Patent Publication No. 11-346972 includes a suction port member as a floor brush and a crevice tool as a suction nozzle, either of which is attached to a body of the cleaner for cleaning a floor and a crevice.

In this portable electric vacuum cleaner, however, the suction port member and the crevice tool are selectively attached to the cleaner body. Therefore, the crevice tool is liable to be missing particularly when the suction port member is attached to the cleaner body.

The portable electric vacuum cleaner disclosed in Japanese Examined Patent Publication No. 7-57214 includes a dust suction port provided in a front end portion of a dust collection case connected to a cleaner body thereof for sucking dust. Thus, the dust is sucked through the suction port.

In this portable electric vacuum cleaner, however, since the suction port is provided in the front end portion of the dust collection case, the front end portion of the dust collection case should be tapered toward the front end of the dust collection case for sucking dust through the suction port. This imposes limitations on the design of the portable electric vacuum cleaner.

The portable electric vacuum cleaner disclosed in Japanese Unexamined Patent Publication No. 10-276942 includes a leg and a handle provided at a rear end of a cleaner body thereof and hence can be kept in a self-standing state with its leg and handle in contact with a floor surface. Thus, space saving can be achieved.

However, this portable electric vacuum cleaner should be lifted and inverted by holding the handle for performing a cleaning operation, because the portable electric vacuum cleaner is in the self-standing state with its handle in contact with the floor surface. Therefore, the handling of the portable electric vacuum cleaner is troublesome.

SUMMARY OF THE INVENTION

In view of the foregoing, it is an object of the present invention to provide a portable electric vacuum cleaner improved in usability.

The present invention provides a portable electric vacuum cleaner, which includes a cleaner body, a suction nozzle of a fixed shape provided unitarily with the body for sucking dust from a distal end thereof and projecting forward from the body as having a predetermined length, and a floor brush having a connection vent to be detachably fitted around the suction nozzle, wherein the floor brush is attached to the suction nozzle for general use of the portable electric vacuum cleaner.

According to the present invention, the portable electric vacuum cleaner has a smaller footprint, because the vacuum cleaner is kept in a self-standing state when the vacuum cleaner is not in use. Further, a casing of the vacuum cleaner is located on a floor surface when the vacuum cleaner is in the self-standing state. There is no significant difference in the orientation of the portable electric vacuum cleaner between the self-standing state and an in-use state, and a cleaning operation can be easily started.

DETAILED DESCRIPTION OF PREFERRED EMBODIMENTS

One embodiment of the present invention will hereinafter be described in detail with reference to the attached drawings.

Figure 1:
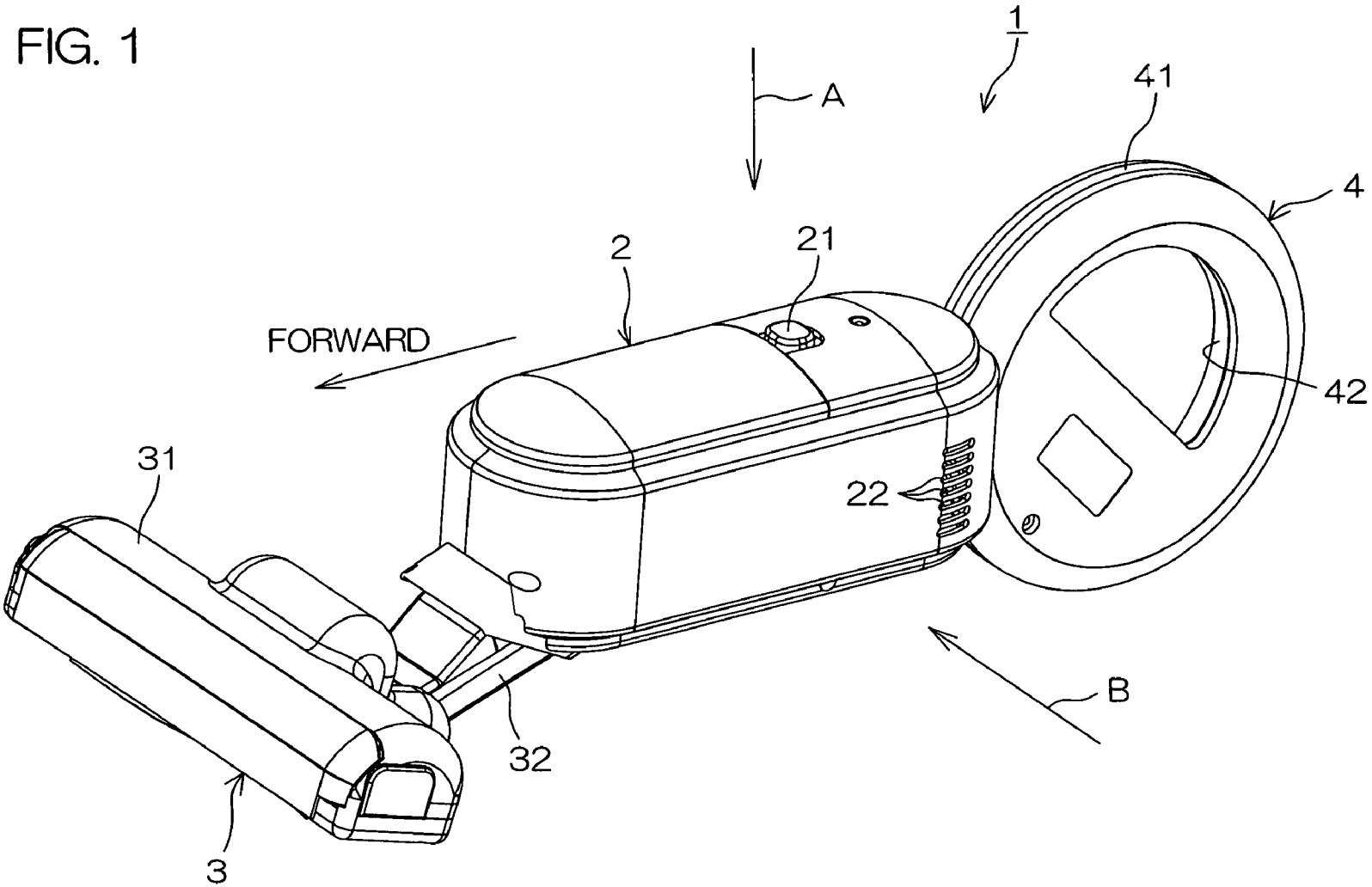
FIG. 1 is a perspective view illustrating the exterior of a portable electric vacuum cleaner according to one embodiment of the present invention.
Figure 2:
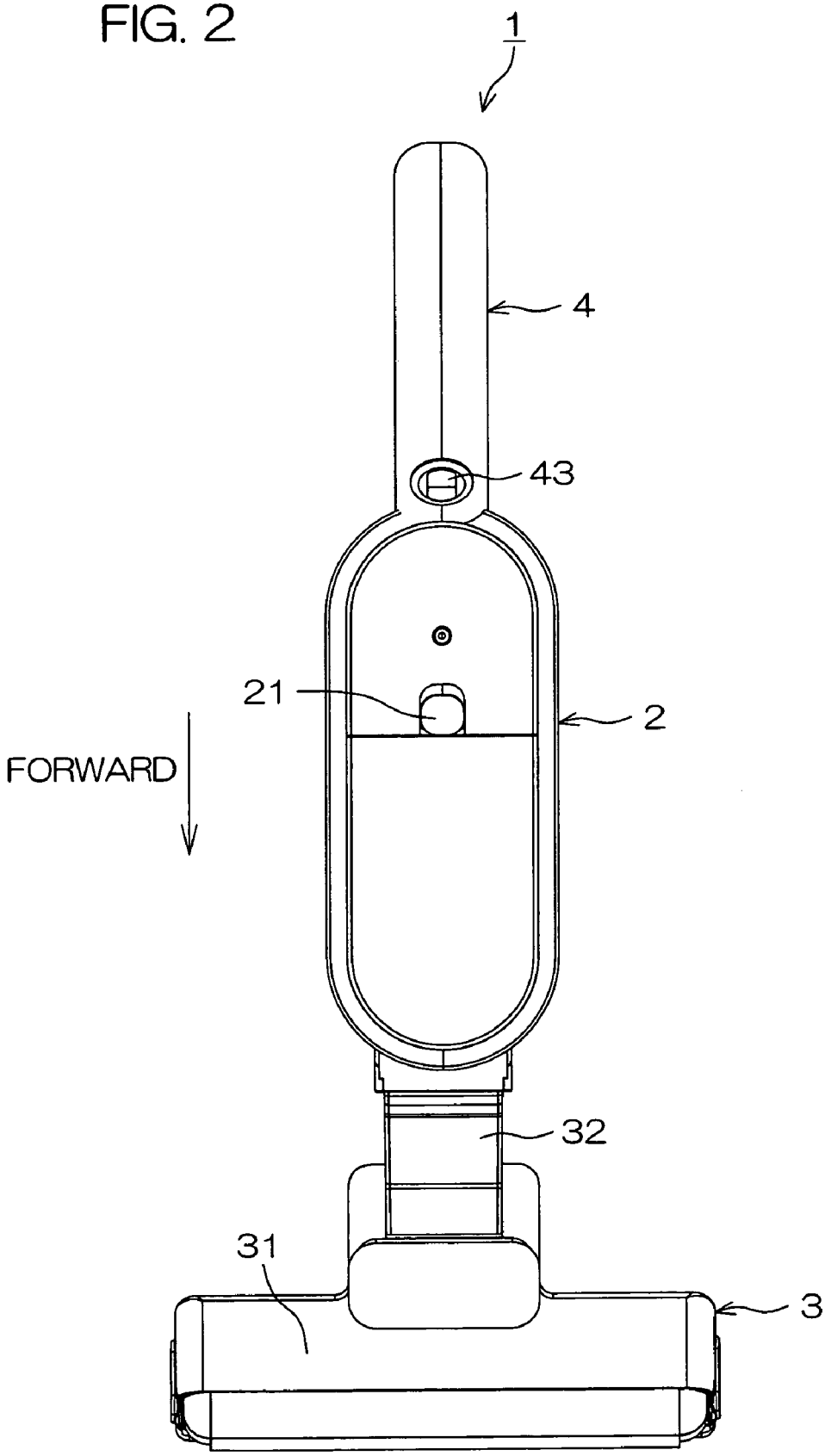
FIG. 2 is a plan view of the portable electric vacuum cleaner as seen in an arrow direction A in FIG. 1.
Figure 3:
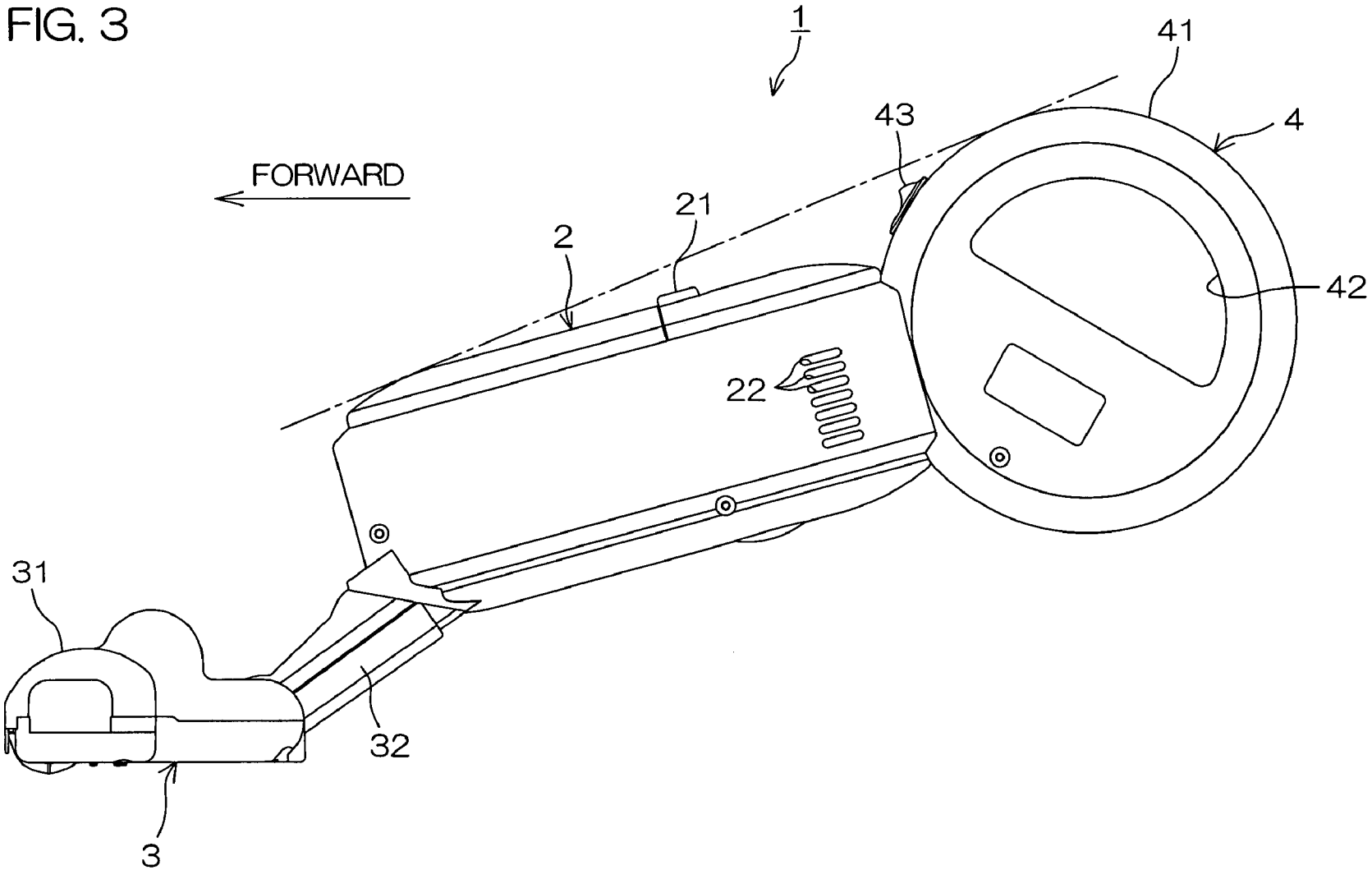
FIG. 3 is a side view of the portable electric vacuum cleaner as seen in an arrow direction B in FIG. 1.

FIG. 1 is a perspective view illustrating the exterior of a portable electric vacuum cleaner 1 according to the embodiment of the present invention. FIG. 2 is a plan view of the cleaner 1 as seen in an arrow direction A in FIG. 1, and FIG. 3 is a side view of the cleaner 1 as seen in an arrow direction B in FIG. 1. Directional expressions in the following description are based on an arrow direction "FORWARD" in FIG. 1.

With the use of the portable electric vacuum cleaner 1, a user performs a cleaning operation while manually lifting and carrying a cleaner body of the vacuum cleaner 1. The portable electric vacuum cleaner 1 includes a body 2 having a generally box shape elongated anteroposteriorly, a floor brush 3 removably attached to a front end of the body 2, and a handle 4 provided unitarily with the body 2 at a rear end of the body 2 and distinguishable from the body 2.

The body 2 is capable of trapping dust sucked therein. An open/close button 21 to be pressed when the dust collected in the body 2 is removed is provided at the center of an upper surface of the body 2, and a plurality of air outlet ports 22 for discharging sucked air are provided in side surfaces of the body 2.

The floor brush 3 is a generally T-shaped member as viewed in plan, and includes a casing 31 extending transversely thereof and a hollow connection vent 32 extending rearward from a rear center portion of the casing 31.

The handle 4 is a generally disk-shaped member, which has a semicircular cut-away portion provided inside the disk as having a radius smaller than the radius of the outer circumference of the disk, and has an outer peripheral surface 41 and an inner peripheral surface 42. The handle 4 is provided unitarily with the body 2 with its front end connected to the body 2, and positioned vertically thereby to be circular in elevation.

A power supply switch 43 for actuating the portable electric vacuum cleaner 1 is provided on the outer peripheral surface 41 of the handle 4. The power supply switch 43 is located on the outer peripheral surface 41 so as not to project outward of a line extending from the front end of the body 2 to a bulged portion of the handle 4 (see FIG. 3). With this arrangement, the user lifts the potable electric vacuum cleaner 1 by holding the outer peripheral surface 41 and the inner peripheral surface 42 of the handle 4, then turns on the power supply switch 43, and carries the portable electric vacuum cleaner 1 to suck dust through the floor brush 3 for cleaning.

Figure 4:
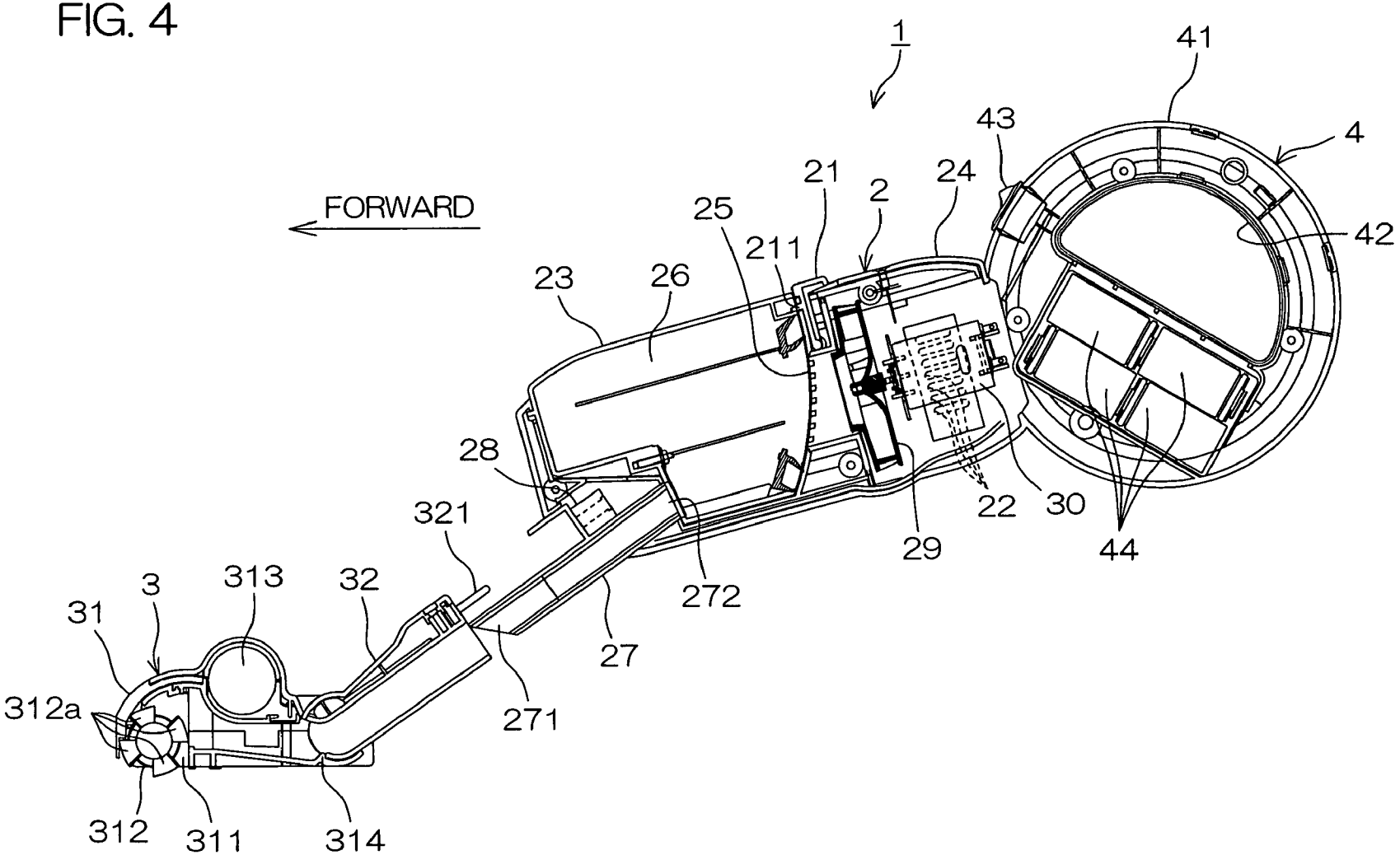
FIG. 4 is a sectional view of the portable electric vacuum cleaner with its floor brush detached from its body, the sectional view being taken along a vertical plane extending anteroposteriorly of the cleaner and seen from a right-hand side.

FIG. 4 is a sectional view of the portable electric vacuum cleaner 1 with the floor brush 3 detached from the body 2, the sectional view being taken along a vertical plane extending anteroposteriorly of the cleaner 1 and seen from a right-hand side. The inside structure of the portable electric vacuum cleaner 1 will be described below in detail.

The body 2 includes a front body 23 and a rear body 24. The front body 23 has a hollow inside which is defined by a front wall, a right side wall, a left side wall, an upper wall and a lower wall, and its rear side is covered with a removable filter 25, whereby a dust collection chamber 26 is defined in the front body 23. A suction nozzle 27 having a predetermined length is provided at a front lower portion of the front body 23 unitarily with the front body 23 as projecting forward, and a power supply connection terminal 28 is provided at a proximal end of the suction nozzle 27.

The suction nozzle 27 is, for example, a tubular member of a fixed shape composed of a resin and tapered toward a distal end thereof. The suction nozzle 27 includes a nozzle suction port 271 provided at the distal end thereof and a nozzle outlet port 272 provided at the proximal end thereof. The nozzle outlet port 272 faces the dust collection chamber 26. Thus, the nozzle suction port 271, the inside space of the suction nozzle 27 and the nozzle outlet port 272 define a single air passage extending from the outside space to the dust collection chamber 26.

Figure 6:
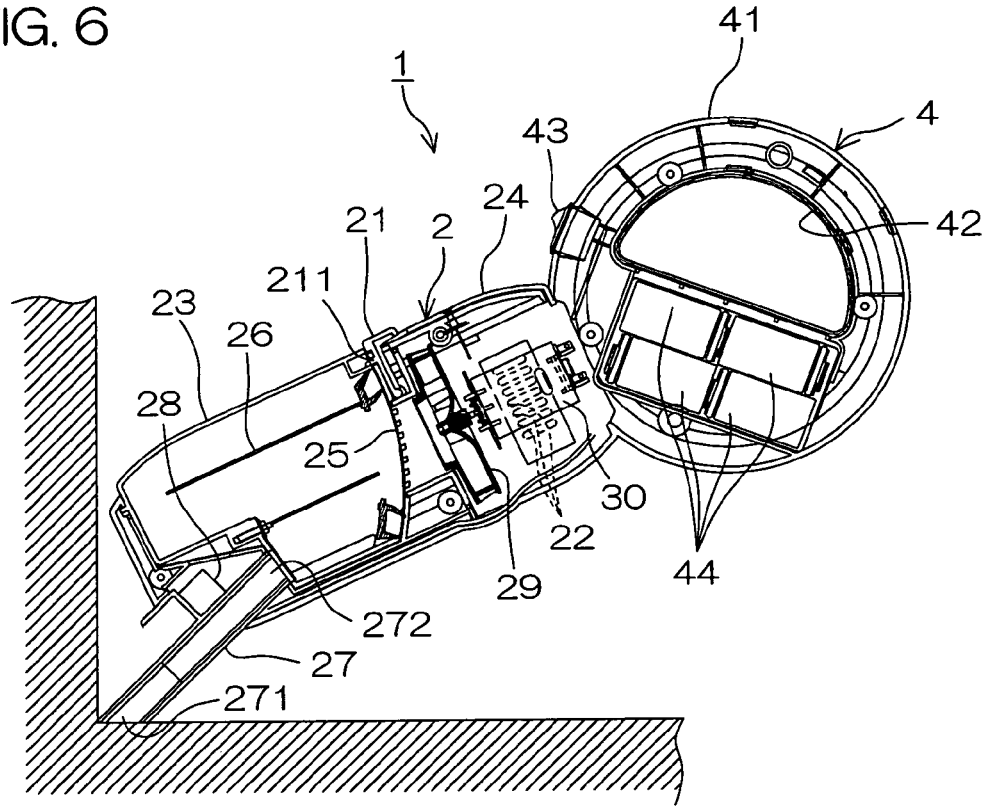
FIG. 6 is a diagram illustrating a state of the portable electric vacuum cleaner used for cleaning with the use of a suction nozzle.

The suction nozzle 27 is mainly used for cleaning a portion of a floor surface through a narrow space. The length of the suction nozzle 27 is such that the nozzle suction port 271 can reach a corner of the floor, for example, even if the body 2 (front body 23) cannot be brought into contact with the floor corner because of interference between the body 2 and a wall or the like as shown in FIG. 6 when the floor corner is cleaned. The power supply connection terminal 28 is an electrical connection terminal, for example, a female connection member.

The rear body 24 has a hollow inside defined by a rear wall, a right side wall, a left side wall, an upper wall and a lower wall. A fan 29 for sucking air and a motor 30 for supplying a driving force to the fan 29 are incorporated in the rear body 24. The plurality of air outlet ports 22 for discharging the air sucked by the fan 29 to the outside are provided in the left and right side walls of the rear body 24. The open/close button 21 is provided at a front end of the upper wall of the rear body 24. The open/close button 21 is disposed so as not to project outward of the line extending from the front end of the body 2 to the bulged portion of the handle 4.

The open/close button 21 is anteroposteriorly resiliently deformable, and has a claw 211 which is engaged with a rear end of the upper wall of the front body 23 with the front body 23 and the rear body 24 kept in intimate contact with each other. The open/close button 21 is biased forward. To disengage the front body 23 from the rear body 24, the open/close button 21 is pressed rearward to be resiliently deformed. Thus, the front body 23 is separated from the rear body 24.

As described above, the floor brush 3 includes the casing 31 which extends perpendicularly to the paper surface of FIG. 4 (laterally), and the connection vent 32 connected to the rear end of the casing 31.

The casing 31 has a hollow inside, and includes a suction port 311 provided in a lower face thereof as extending perpendicularly to the paper surface of FIG. 4. A rotary brush 312 is rotatably provided inside the suction port 311 as extending perpendicularly to the paper surface of FIG. 4. The rotary brush 312 includes a plurality of blades 312*a* provided circumferentially thereof, and the circumference of the rotary brush 312 (blades 312*a*) partly projects from the suction port 311. When the rotary brush 312 is rotated with the casing 31 in press contact with the floor surface, the rotary brush 312 picks up dust. The rotary brush 312 is connected to a brush motor 313 incorporated in the casing 31, and rotated by a driving force transmitted thereto from the brush motor 313.

The connection vent 32 is an elongated tubular member which has substantially the same length as the suction nozzle 27 of the body 2. The connection vent 32 is pivotally connected to the casing 31 at a front end thereof, so that the connection vent 32 is vertically pivotal about the front end thereof. Thus, the vertical angular position of the casing 31 is changed with respect to the body 2. Therefore, the suction port 311 (rotary brush 312) can be kept in contact with the floor surface even if the position of the body 2 is vertically changed. Further, a single air passage is defined by the suction port 311, the inside space of the casing 31 and the inside space of the connection vent 32.

The casing 31 has a projection 314 provided at a junction between the casing 31 and the connection vent 32. When the connection vent 32 is pivoted downward, the projection 314 catches the front end of the connection vent 32 to prevent the connection vent 32 from further pivoting downward from a state shown in FIG. 4. A power receiving connection terminal 321 is provided at a rear upper portion (projection) of the connection vent 32. The power receiving connection terminal 321 is, for example, a male electrical connection member, which is electrically connected to the brush motor 313 via an electric circuit not shown.

Rechargeable batteries 44 are provided as a driving power source in the handle 4, and electrically connected to the motor 30 in the body 2 via the power supply switch 43 by an electric circuit not shown.

Figure 5:
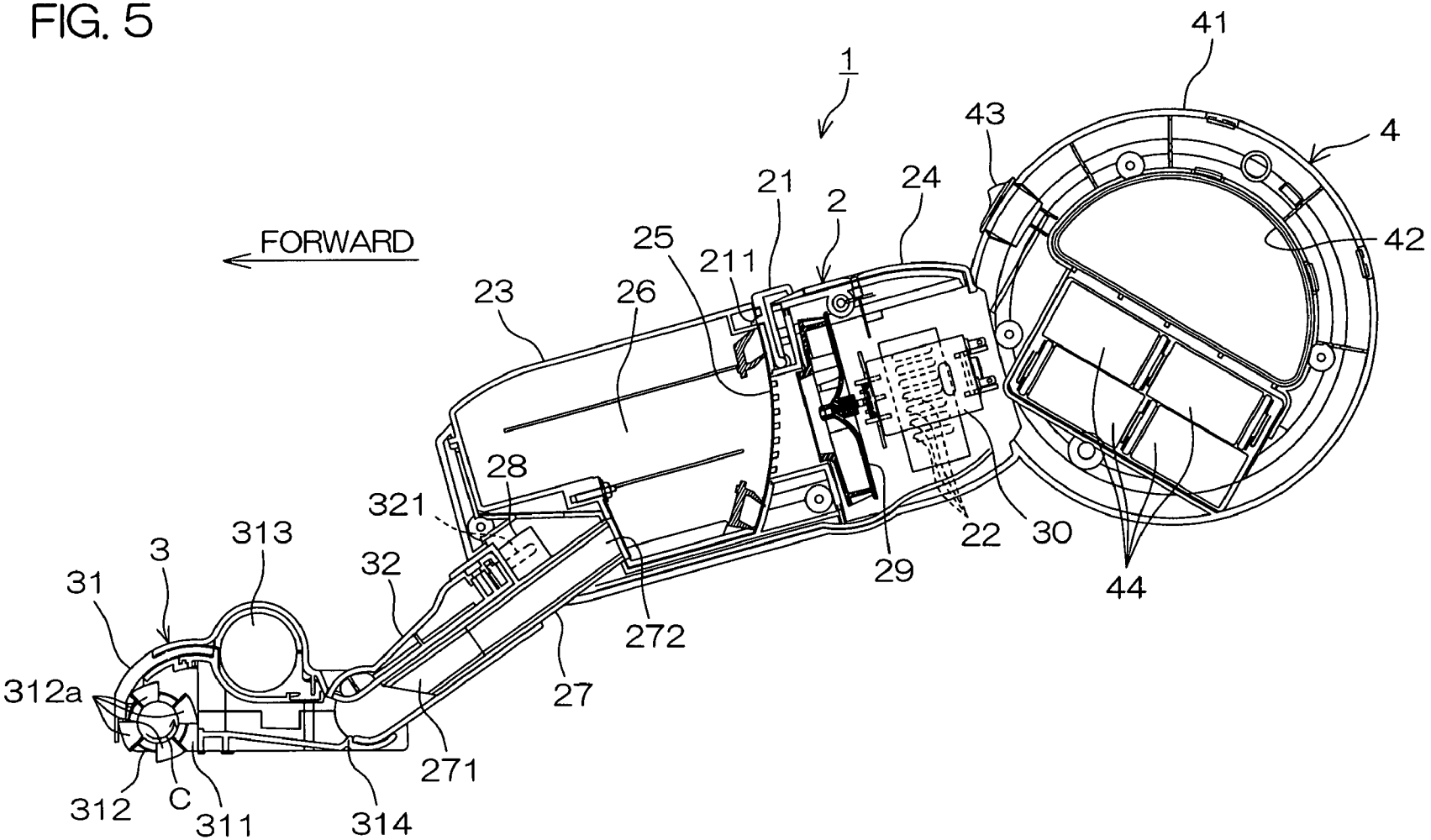
FIG. 5 is a sectional view of the portable electric vacuum cleaner with its floor brush attached to its body, the sectional view being taken along the vertical plane extending anteroposteriorly of the cleaner and seen from the right-hand side.

The floor brush 3 (connection vent 32) is moved rearwardly upward from the state shown in FIG. 4 so as to set the connection vent 32 around the suction nozzle 27 (to insert the suction nozzle 27 into a tubular portion of the connection vent 32), whereby the floor brush 3 is attached to the body 2 as shown in FIG. 5. Thus, a junction between the body 2 and the floor brush 3 has a double structure provided by the suction nozzle 27 and the connection vent 32. In this state, the power receiving connection terminal 321 and the power supply connection terminal 28 are connected to each other.

The power supply connection terminal 28 is electrically connected to the batteries 44 via the power supply switch 43 by an electric circuit not shown. For example, the power supply switch 43 is switched stepwise to two positions. When the power supply switch 43 is switched to a first position, the batteries 44 are electrically connected to the motor 30. When the power supply switch 43 is further switched to a second position, the batteries 44 are electrically connected to the power supply connection terminal 28.

That is, when the power supply switch 43 is switched to the first position with the floor brush 3 attached to the body 2, the motor 30 is driven to rotate the fan 29, whereby air flows from the front side to the rear side of the fan 29. Thus, air flows from the suction port 311 of the floor brush 3 to the inside of the dust collection chamber 26 (a suction force is generated). With the floor brush 3 in contact with the floor surface, dust on the floor surface is sucked through the suction port 311 to pass through the inside of the casing 31 and the inside of the connection vent 32 (suction nozzle 27), and is trapped by the filter 25 in the body 2 (front body 23) thereby to be collected in the dust collection chamber 26. After the dust is trapped, the air is discharged from the air outlet ports 22 of the rear body 24 to the outside. The collected dust is removed by separating the front body 23 from the rear body 24 by operating the open/close button 21.

When the power supply switch 43 is further switched to the second position, the batteries 44 are electrically connected to the brush motor 313 via the power supply connection terminal 28 and the power receiving connection terminal 321 to drive the brush motor 313. The rotary brush 312 is rotated at a predetermined speed in an arrow direction C (see FIG. 5). When the floor brush 3 is brought into contact with the floor surface in this state, the blades 312*a* of the rotary brush 312 pick up the dust on the floor surface. Thus, the dust can be more advantageously sucked.

On the other hand, when the floor brush 3 is detached from the body 2 (front body 23), the suction nozzle 27 appears. When the power supply switch 43 is turned on in this state, the dust is sucked through the nozzle suction port 271 of the suction nozzle 27. Thus, the dust present in the corner of the floor can be advantageously sucked by positioning the suction nozzle 27 (nozzle suction port 271) in the floor corner as shown in FIG. 6.

Since the suction nozzle 27 is provided unitarily with the body 2, there is no possibility to lose the suction nozzle 27. Where the suction nozzle 27 is used for cleaning, it is merely necessary to detach the floor brush 3 from the body 2. Therefore, the portable electric vacuum cleaner 1 is conveniently used. The suction nozzle 27 is hidden with the floor brush 3 attached to the body 2 and, when the floor brush 3 is detached from the body 2, the suction nozzle 27 appears. Therefore, the portable electric vacuum cleaner 1 has a neat appearance.

The length of the suction nozzle 27 is such that the distal end thereof reaches the corner of the floor when the floor corner or the like is cleaned. Thus, even a narrow space can be advantageously cleaned.

Further, the suction nozzle 27 and the connection vent 32 have substantially the same length, so that the junction between the suction nozzle 27 and the connection vent 32 has a double structure. Therefore, the strength of the junction can be increased.

Where the floor brush 3 is attached to the body 2, the junction between the power receiving connection terminal 321 and the power supply connection terminal 28 is spaced a sufficient distance from the floor surface. Therefore, even if dust on the floor surface is stirred up when the floor surface is cleaned with the use of the floor brush 3 attached to the body 2, the dust is less liable to adhere to the junction between the terminals. Further, the power supply connection terminal 28 is disposed at the proximal end of the suction nozzle 27. Therefore, even if dust is stirred up when the suction nozzle 27 is used for cleaning with the floor brush 3 detached from the body 2, the dust is less liable to adhere to the power supply connection terminal 28. Hence, the connection between the power receiving connection terminal 321 and the power supply connection terminal 28 can be properly maintained.

Since the batteries 44 are incorporated in the handle 4, the portable electric vacuum cleaner 1 is kept in good weight balance during use. That is, the batteries 44 which are relatively heavy are disposed in the handle 4 to be held by the user, so that the portable electric vacuum cleaner 1 can be used (or lifted) in well-balanced state by the user.

Figure 7:
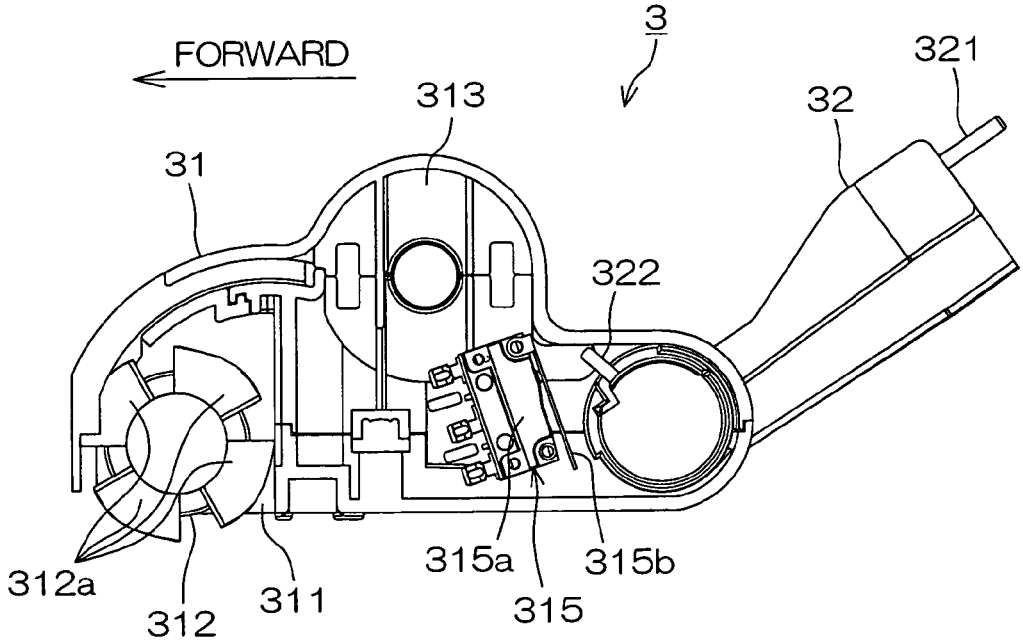
FIG. 7 is a diagram illustrating a state of a floor brush in which a connection vent is maximally pivoted downward.
Figure 8:
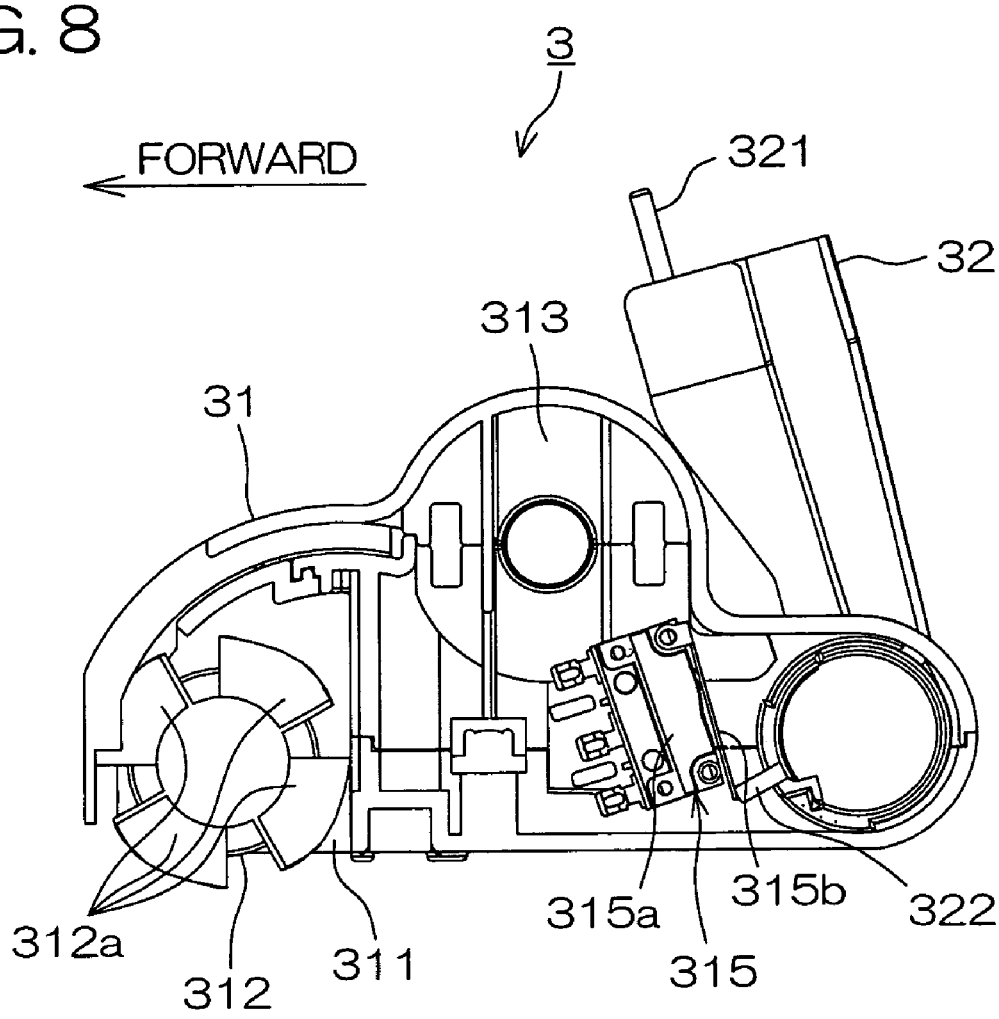
FIG. 8 is a diagram illustrating a state of the floor brush in which the connection vent is maximally pivoted upward.

FIGS. 7 and 8 are diagrams for explaining operation states of the floor brush 3.

FIG. 7 illustrates a state of the floor brush 3 in which the connection vent 32 is maximally pivoted downward (the connection vent 32 is pivoted to the lowermost position). It is noted that the projection 314 of the casing 31 is not shown in FIGS. 7 and 8.

The brush motor 313 is incorporated in the casing 31, and the electrical connection between the brush motor 313 and the power receiving connection terminal 321 is established specifically via a connection switch 315. The connection switch 315 electrically connects and disconnects the brush motor 313 to/from the power receiving connection terminal 321. The connection switch 315 includes a switch body 315*a* and a switch plate 315*b* attached to the switch body 315*a*.

The switch plate 315*b* is pivotally attached to the switch body 315*a* at its upper end, and is pivotal within a very small angular range about the upper end thereof. The switch plate 315*b* is biased upward by a spring or the like, and a lower end of the switch plate 315*b* is apart from the switch body 315*a* as shown in FIG. 7 in an ordinary state. In this state, the connection switch 315 is on, so that the brush motor 313 is electrically connected to the power receiving connection terminal 321.

An abutment projection 322 is provided at the front end of the connection vent 32 as projecting toward the connection switch 315. When the connection vent 32 is (maximally) pivoted upward into contact with an upper wall of the casing 31 (when the connection vent 32 is pivoted to the uppermost position), a distal end of the abutment projection 322 presses the switch plate 315*b* of the connection switch 315 into abutment against the switch plate 315*b* to displace the switch plate 315*b* forward (to pivot the switch plate 315*a* downward). In this state which is shown in FIG. 8, the connection switch 315 is off, so that the brush motor 313 is electrically disconnected from the power receiving connection terminal 321.

That is, when the connection vent 32 is pivoted to the upper most position, the connection switch 315 is turned off to stop the power supply to the brush motor 313. Therefore, the brush motor 313 is not driven.

Figure 9:
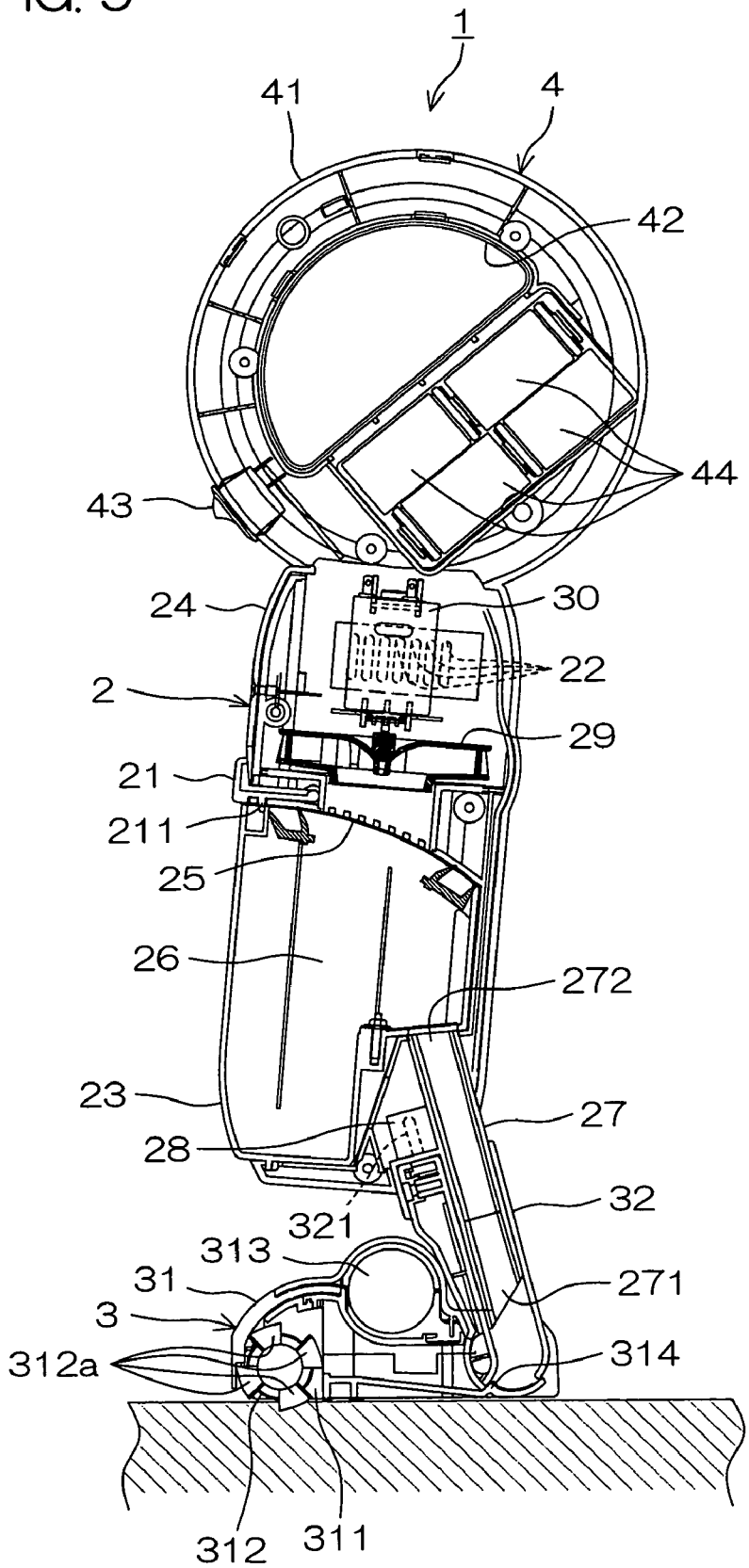
FIG. 9 is a diagram illustrating a self-standing state of the portable electric vacuum cleaner.

FIG. 9 is a diagram illustrating a self-standing state of the portable electric vacuum cleaner 1.

When the portable electric vacuum cleaner 1 is in the self-standing state, a bottom surface of the casing 31 of the floor brush 3 contacts the floor surface. The portable electric vacuum cleaner 1 stably stands upright with the floor brush 3

(the casing 31 and the connection vent 32), the body 2 and the handle 4 vertically connected in series in predetermined angular relation. The floor brush 3 has a charging terminal (not shown), for example, electrically connected to the batteries 44. The charging terminal is connected to a power source terminal (not shown) connected to an external power source, whereby the portable electric vacuum cleaner 1 can be charged in the self-standing state.

This state is such that the connection vent 32 of the floor brush 3 is pivoted to the uppermost position as shown in FIG. 8. That is, the connection switch 315 is in the off state. Therefore, even if the power supply switch 43 is turned on when the portable electric vacuum cleaner 1 is in the self-standing state, the brush motor 313 is not driven to keep the rotary brush 312 inactive.

The portable electric vacuum cleaner 1 can stand upright by itself with the casing 31 of the floor brush 3 in contact with the floor surface. When the portable electric vacuum cleaner 1 is not in use, the footprint of the vacuum cleaner 1 can be reduced by keeping the vacuum cleaner 1 in the self-standing state. The casing 31 contacts the floor surface when the vacuum cleaner 1 is in the self-standing state, so that the cleaning operation can be more easily started.

When the portable electric vacuum cleaner 1 is in the self-standing state (in the charging state), the rotary brush 312 is not rotated. Therefore, the vacuum cleaner 1 is improved in safety.

Figure 10:
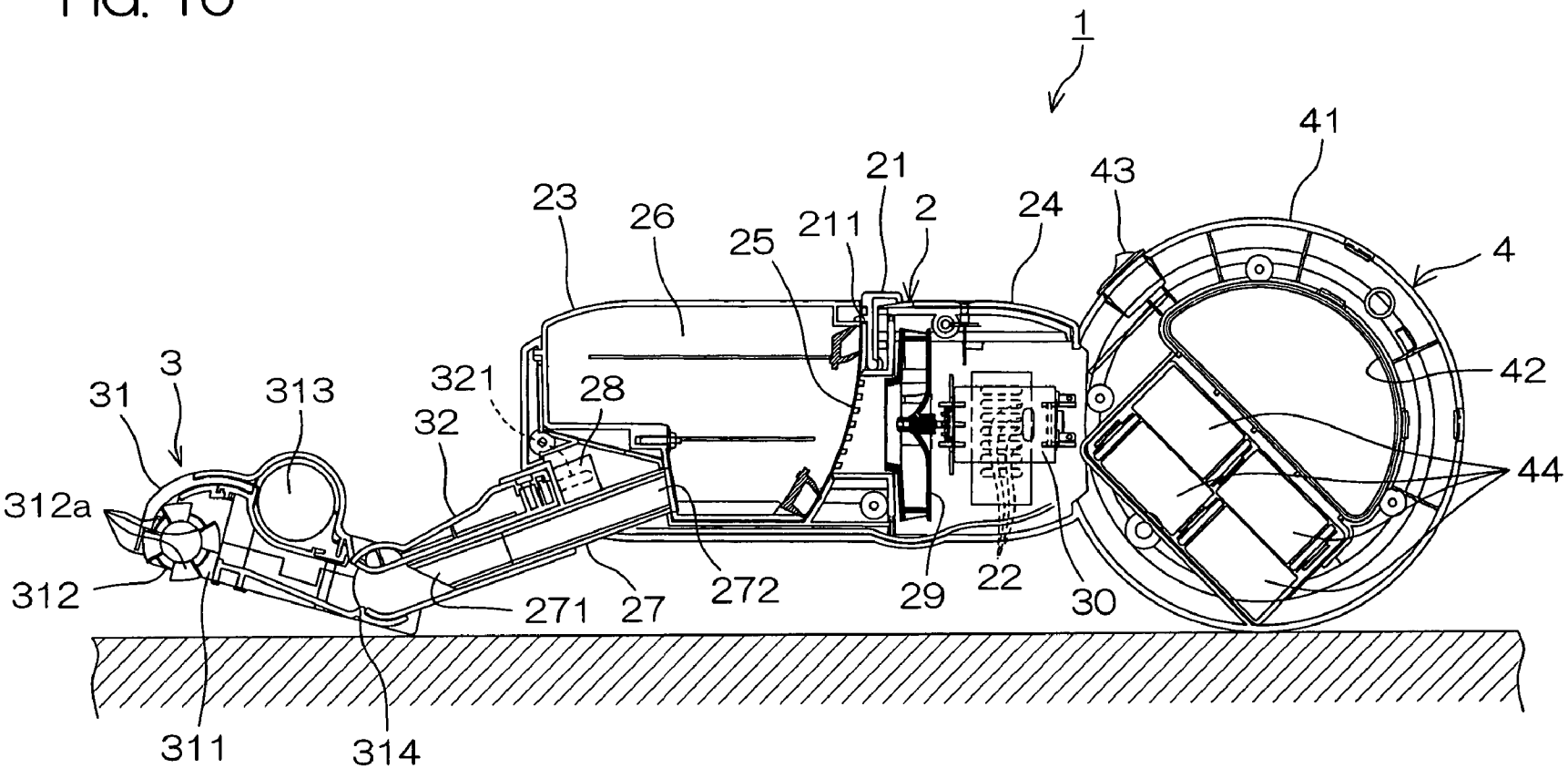
FIG. 10 is a diagram illustrating a reclined state of the portable electric vacuum cleaner with a suction port of the floor brush facing toward a floor surface.

FIG. 10 is a diagram illustrating a reclined state of the portable electric vacuum cleaner 1 with the suction port 311 of the floor brush 3 facing toward the floor surface.

In this state, the handle 4 and the floor brush 3 contact the floor surface. At this time, the floor brush 3 is in such a state that the connection vent 32 is pivoted to the lowermost position as shown in FIG. 7.

That is, the connection vent 32 is pivoted downward about its front end due to the weight of the batteries 44 incorporated in the handle 4. Then, the front end of the connection vent 32 is caught by the projection 314 of the casing 31. Therefore, the casing 31 is pivoted upward about its rear end, and the front end of the casing 31 is lifted. That is, the rotary brush 312 is lifted from the floor surface. Even if the portable electric vacuum cleaner 1 is toppled over when the cleaning operation is performed by rotating the rotary brush 312, for example, the rotary brush 312 does not contact the floor surface. Therefore, the floor surface is prevented from being damaged by the rotating rotary brush 312.

Figure 11:
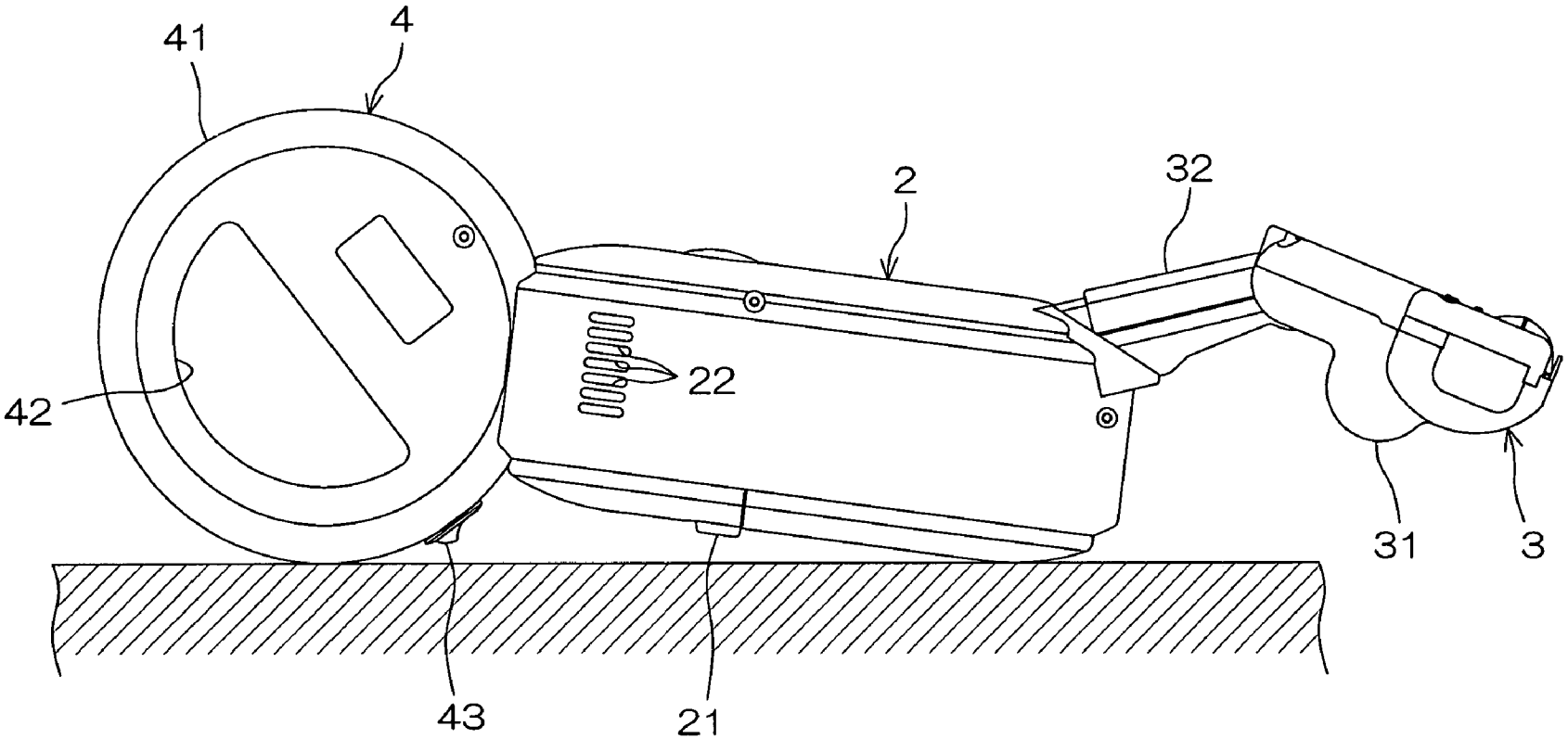
FIG. 11 is diagram illustrating an inverted state of the portable electric vacuum cleaner with its power supply switch facing toward the floor surface.

FIG. 11 is a diagram illustrating an inverted state of the portable electric vacuum cleaner 1 with the suction port 311 of the floor brush 3 upward (with the power supply switch 43 facing toward the floor surface).

In this state, the power supply switch 43 and the open/close button 21 do not contact the floor surface. That is, the power supply switch 43 and the open/close button 21 are respectively provided on the outer peripheral surface 41 of the handle 4 and at the front end on the upper wall of the rear body 24 so as not to project outward of the line extending from the front end of the body 2 to the bulged portion of the handle 4. Therefore, the power supply switch 43 and the open/close button 21 do not contact the floor surface when the portable electric vacuum cleaner 1 is in the inverted state.

That is, even if the portable electric vacuum cleaner 1 is inverted, the power supply switch 43 is prevented from being turned on or off, and the front body 23 is prevented from being separated from the rear body 24. Hence, there is no need to separately provide a member for preventing the switching of the power supply switch 43 and a member for preventing the separation of the front body 23 from the rear body 24. Therefore, the portable electric vacuum cleaner 1 has a neat appearance.

The present invention is not limited to the embodiment described above, but various modifications may be made within the scope of the present invention defined by the appended claims.

This application corresponds to Japanese Patent Application No. 2004-220670 filed with the Japanese Patent Office on Jul. 28, 2004, the disclosure of which is incorporated herein by reference.

What is claimed is:

1. A portable electric vacuum cleaner comprising:

a cleaner body;

a suction nozzle of a fixed shape provided unitarily with the body for sucking dust from a distal end thereof, the suction nozzle projecting forward from the body as having a predetermined length;

wherein the suction nozzle extends away from said cleaner body at a downward angle with respect to the cleaner body; and a floor brush including a connection vent to be detachably fitted around the suction nozzle, wherein the floor brush includes a casing have a suction portion and the connection vent is pivotally connected to the casing as projecting rearward from the casing; and wherein the suction nozzle and the connection vent have substantially the same length, wherein the floor brush is attached to the body by fitting the connection vent around the suction nozzle, so that a junction between the body and the floor brush has a double structure provided by the suction nozzle and the connection vent.

2. A portable electric vacuum cleaner as set forth in claim 1, wherein the length of the suction nozzle is such that the distal end of the suction nozzle reaches a corner of a floor even if the body cannot be brought into abutment against the floor corner because of interference between the body and a wall when the floor corner is cleaned.

3. A portable electric vacuum cleaner as set forth in claim 1, wherein the floor brush further includes:

a rotary brush provided in the suction port; and a motor for rotating the rotary brush, wherein a power receiving connection terminal is provided at a projection end of the connection vent and electrically connected to the motor, wherein a power supply connection terminal to be electrically connected to the power receiving connection terminal when the connection vent is fitted around the suction nozzle is provided at a proximal end of the suction nozzle.

4. A portable electric vacuum cleaner as set forth in claim 3, wherein the connection vent is connected to the casing in a vertically pivotal manner and extending rearward from the casing, wherein the floor brush is attached to the body by fitting the connection vent around the suction nozzle, and the body is brought into a self-standing state with the casing in contact with a floor surface when the connection vent is pivoted to an uppermost position with respect to the casing.

5. A portable electric vacuum cleaner as set forth in claim 3, further comprising switching means which turns on and off power supply to the motor via the power receiving connection terminal depending on a pivot state of the connection vent with respect to the casing.

6. A portable electric vacuum cleaner as set forth in claim 5, wherein the connection vent is vertically pivotal with respect to the casing, and the switching means stops the power supply when the connection vent is pivoted to an uppermost position.

7. A portable electric vacuum cleaner as set forth in claim 3, further comprising pivot position limiting means which limits a pivot position of the connection vent at a predetermined position so as to prevent the suction port of the casing from contacting a floor surface when the body is reclined with respect to the floor brush.

8. A portable electric vacuum cleaner as set forth in claim 1, wherein a dust collection chamber and electric fan means for sucking the dust into the dust collection chamber are incorporated in the cleaner body, wherein a power supply switch for actuating and deactuating the electric fan means is disposed in such a position that the power supply switch is prevented from contacting a floor surface when the body is inverted.

9. A portable electric vacuum cleaner as set forth in claim 8, wherein a handle having a portion bulged from the body is provided unitarily with the body on a rear side of the body, wherein the power supply switch is provided inward of a line extending from a distal end of the body to the bulged portion of the handle.

10. A portable electric vacuum cleaner comprising:

a cleaner body;

a suction nozzle of a fixed shape provided unitarily with the body for sucking dust from a distal end thereof, the suction nozzle projecting forward from the body as having a predetermined length;

wherein said suction nozzle extends away from said cleaner body at a downward angle with respect to the cleaner body;

a floor brush including a connection vent to be detachably fitted around the suction nozzle;

wherein the suction nozzle and the connection vent have substantially the same length, wherein the floor brush is attached to the body by fitting the connection vent around the suction nozzle, so that a junction between the body and the floor brush has a double structure provided by the suction nozzle and the connection vent, and a handle provided unitarily with the body as projecting rearward from the body and distinguishable from the body, wherein a driving power source for driving the electric vacuum cleaner is incorporated in the handle.

11. A portable electric vacuum cleaner as set forth in claim 10, wherein the floor brush includes:

a rotary brush provided in the suction port;

a motor for rotating the rotary brush; and wherein the casing, the connection vent, the body and the handle are connected in predetermined angular relation, whereby the body is kept in a self-standing state with the casing in contact with a floor surface.

* * * * *